United States Patent [19]

Takahashi et al.

[11] Patent Number: 4,493,360

[45] Date of Patent: Jan. 15, 1985

[54] APPARATUS FOR ROTARY CASTING INGOTS

[75] Inventors: Hiroyuki Takahashi, Yokosuka; Tomohiro Ogata, Ohiso, both of Japan

[73] Assignee: Kanto Special Steel Works Ltd., Japan

[21] Appl. No.: 527,510

[22] Filed: Aug. 30, 1983

Related U.S. Application Data

[63] Continuation of Ser. No. 228,810, Jan. 27, 1981, abandoned.

[30] Foreign Application Priority Data

Jan. 27, 1980 [JP] Japan ..... 55-8017

[51] Int. Cl.[3] ..... B22D 13/00

[52] U.S. Cl. ..... 164/286; 164/342

[58] Field of Search ..... 164/114, 136, 133, 286, 164/DIG. 6, 363, 342; 249/109

[56] References Cited

U.S. PATENT DOCUMENTS

| | | | |
|---|---|---|---|
| 5,528 | 4/1848 | Graves et al. | 164/363 |
| 364,098 | 5/1887 | Flagler | 164/363 X |
| 638,908 | 12/1899 | Cosgrave | 164/136 X |
| 813,405 | 2/1906 | Cook et al. | 164/363 X |
| 1,131,697 | 3/1915 | Hess | 164/114 X |
| 1,172,506 | 2/1916 | Vickers | 164/363 X |
| 1,410,777 | 3/1922 | Thomes | 164/363 X |
| 1,620,011 | 3/1927 | Dornin | 164/363 X |
| 1,817,340 | 8/1931 | Barr | 164/342 X |
| 2,459,025 | 1/1949 | Graham | 164/363 |

FOREIGN PATENT DOCUMENTS

| | | | |
|---|---|---|---|
| 13599 | 8/1881 | Fed. Rep. of Germany | 164/286 |
| 2250591 | 6/1975 | France | 249/109 |
| 45-15002 | 5/1970 | Japan | 249/109 |
| 393766 | 6/1933 | United Kingdom | 164/286 |

*Primary Examiner*—Kuang Y. Lin
*Assistant Examiner*—J. Reed Batten, Jr.
*Attorney, Agent, or Firm*—Wenderoth, Lind & Ponack

[57] ABSTRACT

Molten metal is poured into a substantially cylindrical mold from its bottom while the mold is being rotated about its vertical center axis. The ingot-making apparatus comprises a substantially cylindrical mold, stool, vertical pouring channel communicating with a runner provided in the stool, metal receiver communicating with the top of the pouring channel, and a rotary table on which the mold is placed through the stool. The metal receiver is shaped like a body of rotation formed by rotating a curve having an opening at the top in a vertical plane about the axis of rotation of the rotary table.

8 Claims, 17 Drawing Figures

APPARATUS FOR ROTARY CASTING INGOTS

This application is a continuation of now abandoned application Ser. No. 228,810, filed Jan. 27, 1981.

BACKGROUND OF THE INVENTION

This invention relates to a method and apparatus for making castings called ingots, especially cylindrical ones.

It is well-known that there are two ways of casting molten metal; top pouring and bottom pouring.

Top pouring is a method that has been in use for a long time. One of the shortcomings of top pouring is that liquid metal flows out of a ladle at high speed because of the high static pressure in the ladle. On being poured into a mold, the metal violently strikes the stool at the bottom of the mold, scattering in the form of droplets. Part of the droplets adheres to the inner walls of the mold which deteriorates the surface of the ingots. The other part, repelled by the inner walls, drops into the liquid metal pooled in the mold. The repelled droplets become oxidized in the atmosphere, so that the iron oxide at the surface of the droplets and the carbon in the molten metal react with each other to evolve gases which, in turn, form blowholes.

To keep the liquid metal hot, a heat-retaining agent or the like is usually added to the mold. Such additives are often swallowed up by the pouring stream, giving rise to slag inclusions and other similar defects.

For these reasons, splash-preventing stools, cylinders or other devices have been employed but none are 100 percent satisfactory.

Bottom pouring is one of the methods which have come into increasing use to overcome the disadvantages of top pouring.

In bottom pouring, the flow energy of the pouring stream is reduced by the resistance offered by the fountain and runner which connect the ladle and the mold. Entering through the outlet at the bottom of the mold, the molten metal rises very steadily and quietly in the mold, without causing splashing. The result is a good ingot surface.

To produce clean ingots with uniform structure, various kinds of special ingot-making methods have come into use.

Rotary ingot-making is one example. According to this method, liquid metal is poured into a mold which is turned around on a rotating plate, the rotation being continued until the metal solidifies to a desired thickness. Accordingly, non-metallic inclusions with low specific gravity move toward the center and float up to provide greater opportunity to become removed. With non-metallic inclusions thus eliminated, ingots with good internal cleanliness result.

The trouble with the conventional rotary ingot-making is in that it has been conducted on the top pouring principle (as disclosed in the Japanese Patent Publication Nos. 11113 of 1961 and 39597 of 1971). When operated in this way, the surface of the molten metal in the rotating mold becomes parabolic, under the effect of centrifugal force, rising toward the mold walls and dipping in the center. As a result, more violet splashing occurs than in the stationary top-poured casting, damaging the ingot quality to a greater extent. To reduce such vigorous splashing, a splash preventing cylinder is inserted in the mold, but the result is not quite satisfactory.

SUMMARY OF THE INVENTION

This invention has been made with a view towards solving the aforementioned problems with ingot-making. Therefore, an object of this invention is to provide a method and apparatus to make ingots having a good surface with few surface defects and at the same time containing little non-metallic inclusions.

Another object of this invention is to provide a simple apparatus permitting rotary ingot-making on the bottom pouring principle.

According to this invention, a substantially cylindrical mold is placed on a rotatable base, with a stool therebetween, so that the central axis of the mold is substantially aligned with the rotating axis of the base. While rotating the mold, stool, a pouring channel leading to the runner provided in the stool, and a metal receiver at the top of the pouring channel en bloc, molten metal is supplied into the mold from bottom.

This splash-free bottom pouring produces smooth-surfaced ingots with few surface defects. Rotating the mold brings non-metallic inclusions and gases to the center of the metal surface, which are then moved into the hot top with ease. As a result, the molten metal solidifies to form a clean ingot with a uniform internal structure.

The metal receiver is shaped like a body of rotation formed by rotating a curve having an opening at the top in a vertical plane about said rotating axis. With this design, the opening of the metal receiver is always held in position to receive the liquid metal from the ladle or the like even when the metal receiver is rotating with the mold. This permits continuing bottom pouring without interruption. The supply of liquid metal from the ladle to the mold can be accomplished without providing any special joint to the pouring channel etc. So the structure of the apparatus is very simple.

BRIEF DESCRIPTION OF THE DRAWINGS

FIGS. 3*a*, 3*b* and 3*c* show an arrangement with one, two and three fountains, respectively.

FIG. 6*a* shows a mold with one fountain.

FIGS. 9*a* and 9*b* show embodiments in which a fountain is fitted in a dovetail groove formed in the mold.

Figure 10:
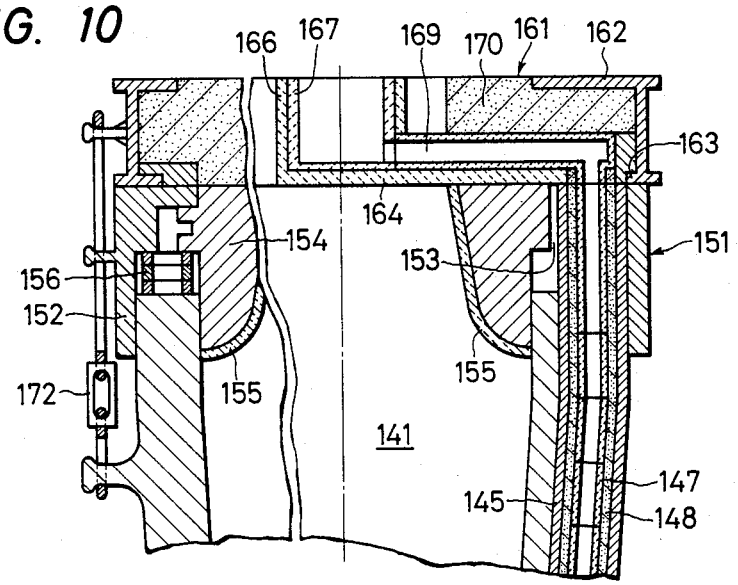
Figure 11:
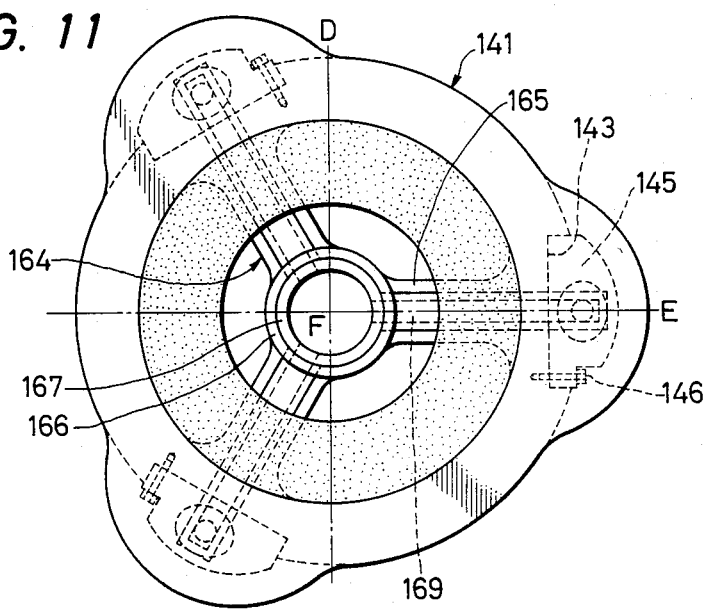

FIG. 10 is a cross section showing an assembly of a fountain-attached mold, hot top, and metal receiver; the left half of the view is taken along the line DF of FIG. 11 and the right half along the line EF.

FIG. 11 is a plan view of FIG. 10.

DETAILED DESCRIPTION OF THE PREFERRED EMBODIMENTS

Figure 1:
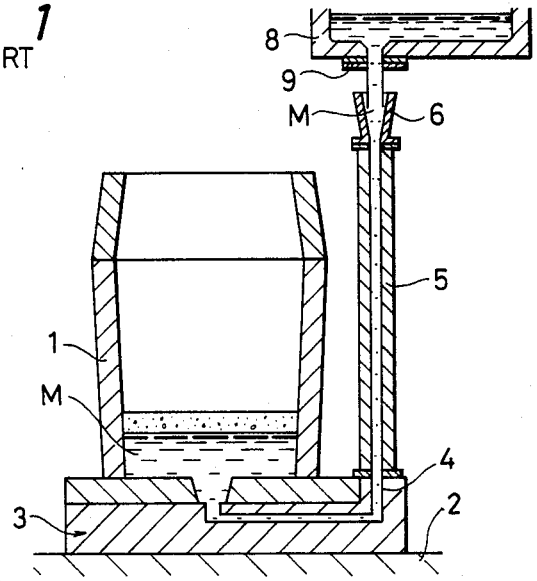
FIG. 1 PRIOR ART
FIG. 1 shows, in cross section, a mold, stool, vertical pouring channel or fountain, and part of a ladle which make up a common conventional bottom-pouring ingot-making apparatus.

FIG. 1 shows a conventional bottom-pouring ingot-making apparatus in popular use. A mold 1 is placed on a stool 3 mounted on a working floor 2. The stool 3 is provided with a runner 4, and a vertical fountain 5 is communicatingly attached to the runner 4. At the top of the fountain 5 is provided a pouring funnel 6.

Before casting, the mold 1, stool 3 and fountain 5 are set as illustrated. Molten metal M is poured from the nozzle 9 of a ladle 8 into the metal receiver 6. The molten metal M then passes through the fountain 5 and runner 4, and enters the mold 1 from the bottom thereof. When the molten metal M has solidified completely in the mold 1, the mold 1, stool 3 and fountain 5 are disassembled to strip the formed ingot out of the mold 1.

But such a bottom pouring practice has not permitted combination with a rotary ingot-making method because of the following difficulties:

(1) Because the fountain 5 is stationary, a joint to connect with the rotating mold 1 must be provided somewhere along the way down to the mold bottom. But such a perfect joint that is safe and leaks no molten metal under high-speed rotation and high pressure is not available.

(2) If the joint were made integral, the fountain 5 too would rotate about the rotating axis of the mold 1, making it impossible to pour the molten metal from the stationary ladle 8.

Thus, bottom-poured rotary ingot-making has been absolutely impracticable.

Now this invention has made bottom-poured rotary ingot-making possible by obviating the aforementioned shortcomings.

This invention takes notice of the fact that rotary bottom pouring can be accomplished without using a joint between the rotating and non-rotating parts that has previously presented the greatest difficulty.

One feature of this invention is the elimination of such a joint by integrating the metal receiver, fountain and runner with the mold and stool so that the whole assembly is rotatable in one piece.

Another feature of this invention is that the metal receiver is put in a position that includes the rotating axis of the mold.

Figure 2:
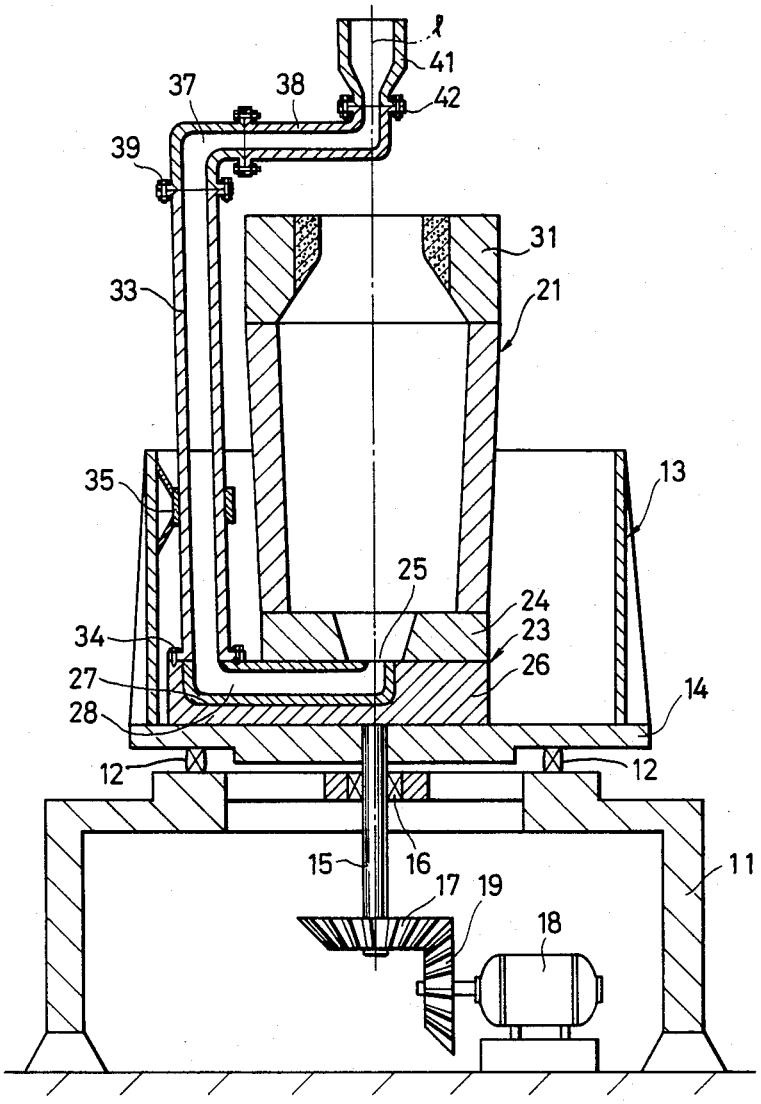
FIG. 2 is a vertical cross section showing an ingot-making apparatus according to this invention.

FIG. 2 shows an apparatus with which the ingot-making method of this invention is applied.

A rotating frame 13 is mounted on a support 11, with a bearing 12 therebetween, so as to be rotatable about a vertical central axis l. To the center of the bottom plate 14 of the rotating frame 13 is attached a rotating shaft 15 extending downward. The intermediate part of the rotating shaft 15 is supported by a bearing 16 held by the support 11, with a bevel gear 17 fastened to the lowest end thereof. A reduction-gear-attached motor 18 is provided under the support 11, and a bevel gear 19 geared with said bevel gear 17 is fastened to the output shaft of the motor 18.

Mold 21 is substantially cylindrical in shape, and slightly tapered to facilitate ingot stripping. The mold 21 is placed on the bottom plate 14 of the rotating frame 13, with a stool 23 therebetween, so that the central axis of the mold 21 is substantially aligned with the vertical rotating axis l. A hot top 31 is placed on top of the mold 21.

The stool 23 consists of an upper board 24 and a lower board 26. The upper board 24 has an outlet 25, shaped like an inverted truncated cone, at the center. The lower board 26 has a groove 27 that extends from near one edge to the center thereof. A runner 28 made of refractory brick is fitted in this groove 27. The upper board 24 and lower board 26 are placed, one above the other, on the bottom plate 14 of the rotating frame 13 so that the outlet 25 and the exit end of the runner 28 are positioned on the vertical center axis l. With the stool 23 thus set, the upper board 24 presses the runner 28 against the lower board 26.

A vertical fountain 33 is fastened with bolts 34 to the lower board 26 so as to communicate with the entry end of the runner 28. The fountain 33 is lined with foundry sand or refractories. The intermediate part of the fountain 33 is supported by the rotating frame 13 by way of a metal holder 35 so as to withstand high-speed rotation. With bolts 39, elbows 37 and 38 are fastened to the top of the fountain 33. The elbow 38 horizontally extends over the mold 21 so that the entry end thereof opens upward on the vertical center axis l. To the entry end of the elbow 38 is attached a metal receiver 41 with bolts 42.

By means of an apparatus thus composed, ingots are cast as described in the following.

To being with, the integral assembly of the mold 21 and other units is rotated at a predetermined speed (e.g., 30–100 rpm) by the motor 18 through the rotating shaft 15. Then, molten metal is poured into the metal receiver 41 by opening the stopper (not shown) of the ladle.

The poured liquid metal passes through the fountain 33 and runner 28, then begins to enter the bottom of the mold 21 through the outlet 25 in the upper board 24, steadily increasing the volume of a pool in the mold.

Being bottom poured, the molten metal spouts quietly from the outlet 25, causing little splashing.

Because of centrifugal force, the poured liquid metal is pushed against the wall of the mold 21 to describe a parabola. As a consequence, non-metallic inclusions and gases move to the center of the mold 21, then moving into the hot top 31 as casting proceeds.

When the molten metal has filled the mold 21 and hot top 31, the stopper is closed and thus pouring is stopped. After being rotated over a desired period of time following the completion of pouring, the mold 21 is brought to a standstill to complete one cycle of the ingot casting operation.

In the above-described example, the liquid metal is poured into the mold 21 being fully rotated. But pouring may also be started while the mold rotation has not yet reached a full stage, with the number of rotations being then increased gradually. Or, the mold may be held at rest in the beginning, then made to start rotation after a pool of liquid metal collects in the mold to a certain extent.

When the metal has completely solidified in the mold 21, the fountain 33 is detached from the stool 23, and the mold 21, still holding the ingot, and the stool 23 are taken out of the rotating frame 13. Then, the ingot is stripped from the mold 21.

Figure 3A:
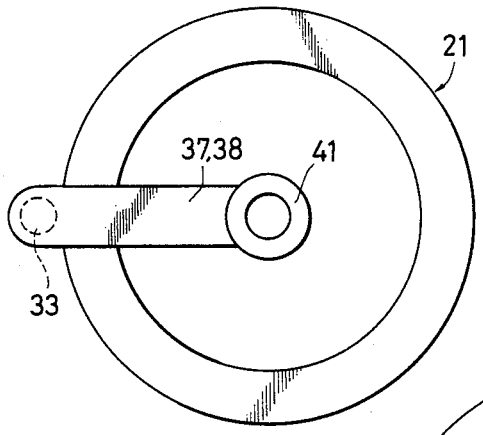
FIGS. 3*a. b* and *c* comprise three plan views showing the arrangement of the fountain according to this invention.

FIGS. 3*a*, *b* and *c* comprise three plan views showing the arrangement of the fountain. FIG. 3*a* is similar to the embodiment shown in FIG. 2 in which one fountain 33 is provided.

When a high speed rotation of the mold and/or high casting rate is desired, to withstand the vibration and maintain the balance of centrifugal force, two or more fountains may be used. To provide adequate vibration resistance, use of two or three fountains, as shown in FIGS. 3*b* and 3*c*, is preferable.

Figure 3B:
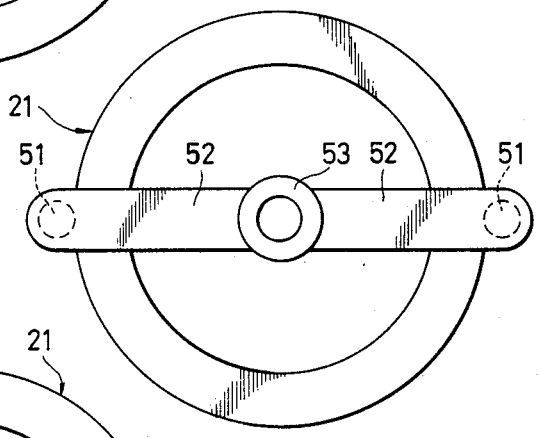
Figure 3C:
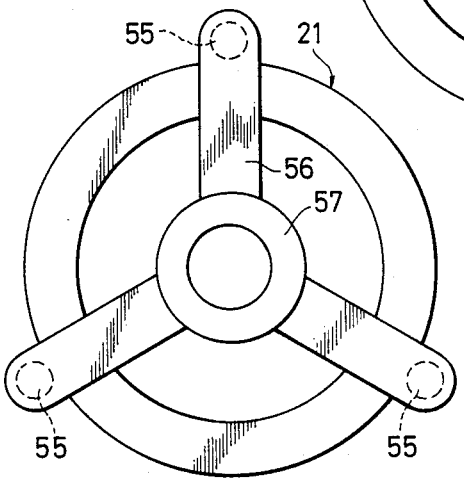

In FIG. 3*b*, two fountains 51 are spaced at the opposite side around the mold 21, each of which communicating with a metal receiver 53 through an elbow 52. In FIG. 3*c*, three fountains 55 are spaced at angular intervals of 120 degrees around the mold 21, each of which communicating with a metal receiver 57 through an elbow 56. In thus providing a plurality of fountains, the fountains must be regularly spaced around the mold as stated above, in order to minimize the resultant force and moment of inertia derived from the rotation.

In the embodiment being discussed, the metal receiver 41 is shaped like a funnel. The metal receiver 41 may also be shaped like a doughnut, containing the axis of rotation, or modifications thereof, so long as the poured liquid metal can be properly received. In other words, any shape is acceptable if only the metal receiver has a top opening that is always so positioned as to receive the stream of molten metal poured from the ladle above, while rotating about the vertical center axis l.

Figure 4:
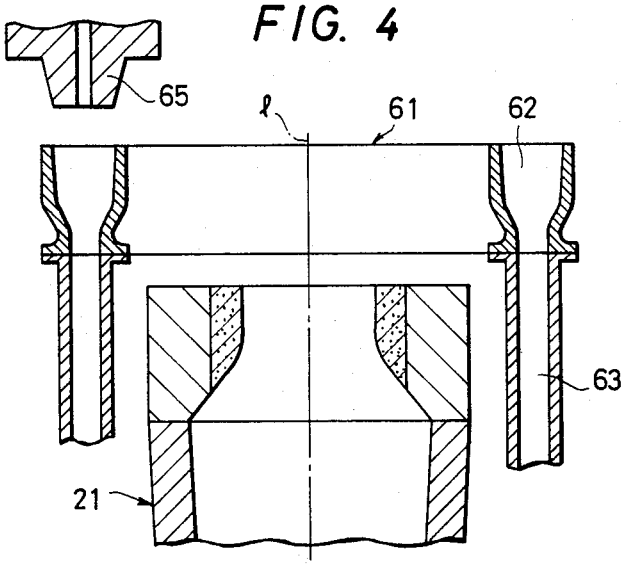
FIG. 4 is a vertical cross section showing another embodiment of the metal receiver according to this invention, along with the mold and part of the fountain.

FIG. 4 shows another embodiment of the metal receiver. This metal receiver 61 consists of an annular trough 62 that is supported by two or three fountains 63 so as to be positioned over the mold 21. The metal receiver 61 is disposed so that the center line thereof is substantially aligned with the vertical center axis l. The nozzle 65 of the ladle is positioned over the metal receiver 61. Therefore, the metal receiver 61 can always receive the liquid metal from the nozzle 65, even while rotating about the vertical center axis l.

The ingot-making method of this invention has greater effects on larger ingots rotated at higher speeds.

There is no need to limit the fastening method and shape of the rotating frame, provided that the fountain and metal receiver can well withstand the centrifugal force and vibration imposed thereon.

The ingots manufactured according to the method of this invention showed the same smooth surface free from pitting and other surface defects as those cast by the stationary bottom-pouring method. The interior was satisfactorily clean, with a uniform structure and typical of the rotary ingot casting method. In a word, the resultant ingots proved sound and satisfactory, both inside and out-side.

As will be understood from the above, the ingot-making method of this invention is applicable to the manufacture of ordinary steel inputs. But it has particularly great effect on such ingots for rolling-mill rolls which are required to have high internal cleanliness and fine-grained uniform structure.

In the foregoing embodiments, the pouring channel takes the form of a pipe-like fountain provided away from the mold. In the following embodiments, the pouring channel is provided integrally within the mold.

Figure 5:
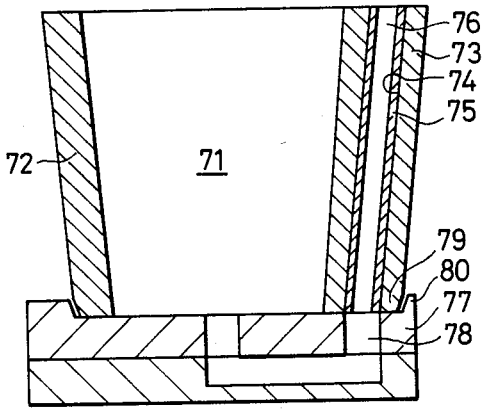
FIG. 5 is a cross-sectional view of an embodiment in which the fountain is provided in the mold wall.

As shown in FIG. 5, part of the wall 72 of a mold 71 is made thicker, and a vertical opening 74 for pouring channel passing through the thick-walled part 73 is provided.

As will be described later, this vertical opening 74 is lined with refractory bricks 75, which are fixed in position by dry sand filled therearound, thus forming a pouring channel 76.

This does away with the separate fountain and means for supporting and fixing it.

Figure 6A:
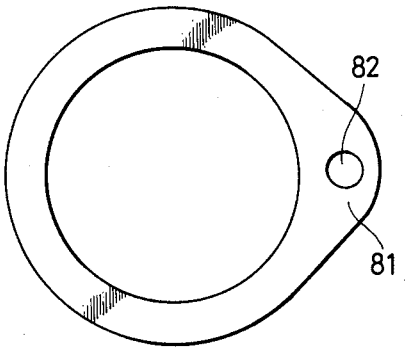
FIGS. 6*a* and *b* comprise two plan views of molds having the fountain in the wall thereof.
Figure 6B:
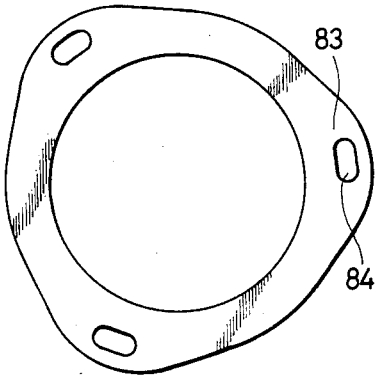
FIG. 6*b* shows a mold with three fountains.

FIGS. 6*a* and *b* show two molds of the above-described type in plan view. FIG. 6*a* shows an embodiment having one pouring channel 82 in the wall of the mold 81, while FIG. 6*b* shows another embodiment having three pouring channels 84 in the wall of the mold 83. From the viewpoint of dynamic balance, providing two or three pouring channels is preferable.

To reduce the mold wall thickness variation and attain uniform cooling rate, the cross-sectional shape of the pouring channel 84 may be made elliptical or slot-like, as shown in FIG. 6*b*.

The pouring channel 76 in the mold 71 and the runner 78 in the upper board 77 can be set without difficulty by adapting the mold bottom 79 to be fitted in the upper board projection 80 like a faucet joint, as shown in FIG. 5. This permits a provisional rough positioning, both sideways and circumferentially, which can be followed by an easy exact alignment, irrespective of the number of the pouring channel 76.

Figure 7:
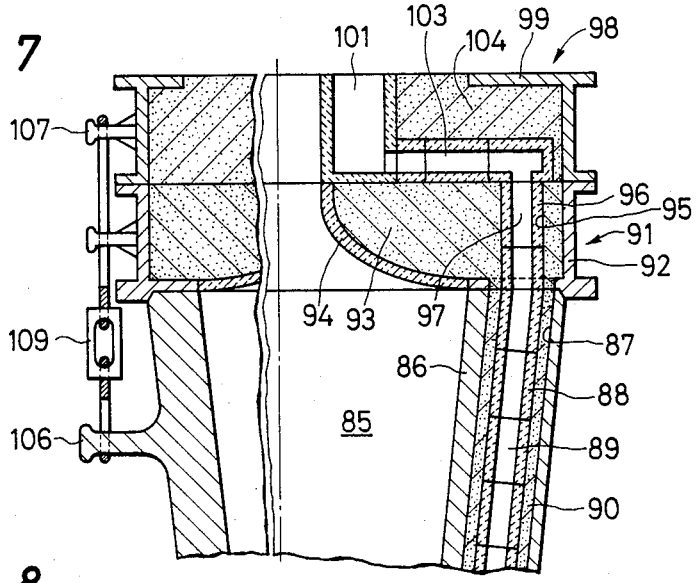
FIG. 7 is a cross section showing an assembly of a mold having a fountain inside, hot top, and metal receiver; the left half of the view is taken along the line AC of FIG. 8 and the right half along the line BC.
Figure 8:
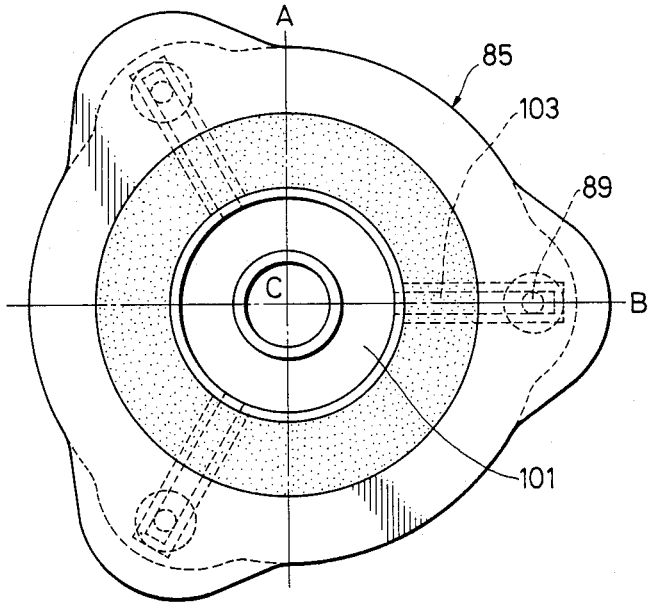
FIG. 8 is a plan view of FIG. 7.
Figure 9A:
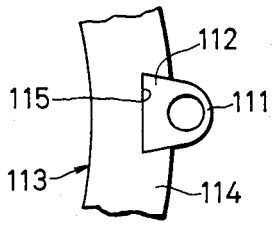
FIGS. 9*a, b, c* and *d* comprise four plan views showing part of a mold attached with a fountain.
Figure 9B:
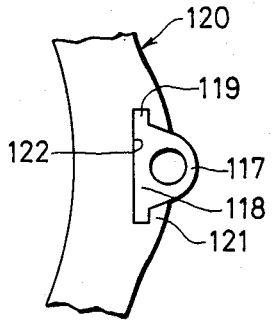
Figure 9C:
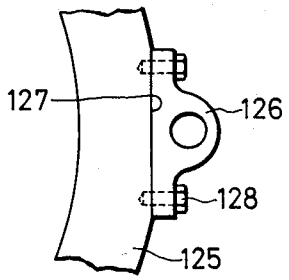
FIGS. 9*c* and 9*d* show embodiments in which a fountain is bolted to the outside of the mold.
Figure 9D:
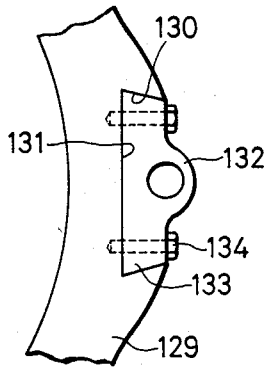

FIGS. 7 and 8 show a mold having pouring channels in the wall thereof and a metal receiver assembly to supply liquid metal thereto.

As shown, three vertical openings 87 are provided in the mold wall 86, spaced at angular intervals of 120 degrees. Into each of these openings 87, a number of cylindrical refractory bricks 88 are set in to form a pouring channel 89. Foundry sand 90 is filled in a space between the surface of the vertical opening 87 and the external surface of the refractory bricks 88, thereby fixing the refractory bricks 88 in the vertical opening 87.

A hot top 91 to be placed on top of a mold 85 has an annular frame 92 whose diameter is substantially equal to that of the top of the mold 85. The annular frame 92 has a sand mold 93 projecting inward. The surface of the sand mold 93 is lined with a heat-insulating material 94. The sand mold 93 has a vertical opening 95, in which a cylindrical refractory brick 96 is fitted. The hot top 91 is placed on top of the mold 85 so that the opening 97 of the refractory brick 96 communicates with the pouring channel 89 provided in the mold 85.

A metal receiver assembly 98, consisting of an annular frame 99, a metal receiver 101 and a communication channel 103, rests on the hot top 91. The annular frame 99 is placed on the annular frame 92 of the hot top 91 that has the same diameter. The metal receiver 101 is an annular trough made of refractory brick. The metal receiver 101 is mounted on the sand mold 93. The communication channel 103, lined with refractory brick, is placed on the sand mold 93 so as to connect the opening 97 in the hot top 91 with the lower part of the metal receiver 101. Foundry sand 104 is filled in a space surrounded by the annular frame 99, metal receiver 101 and communication channel 103.

The hot top 91 and the metal receiver assembly 98 are fastened on top of the mold 85 by means of a turnbuckle 109 engaged with the projections 106 and 107 on the mold 85 and annular frame 99.

The mold 85, hot top 91 and metal receiver assembly 98 thus put together are placed on a rotating table (not shown), with a stool (not shown) therebetween, as in the embodiment of FIG. 2. The liquid metal supplied to the metal receiver 101 passes through the communication channel 103, the opening 97 in the hot top 91, the pouring channel 89 and the runner (not shown) into the mold 85.

FIGS. *9a, b, c* and *d* show other embodiments, in which the mold and fountain are assembled into one piece by fitting together the groove, projection and/or fastening face correspondingly formed thereon or by use of bolts and the like.

In an embodiment shown in FIG. *9a*, a fountain 111 is fastened to a mold 113 by fitting a dovetail 112 on the fountain 111 tightly in a corresponding vertical dovetail groove 115 provided in the mold wall 114.

In an embodiment shown in FIG. *9b*, a dovetail 118 on a fountain 117 has a projection 119, and a corresponding dovetail groove 122, having a recess to receive the projection 119 of the dovetail 118, is cut in the mold wall 121. The fountain 117 of this embodiment is more securely fastened to the mold 120 than the one in FIG. *9a*.

The fountains of the foregoing two embodiments are fitted in the respective dovetail grooves in the following manner. The molds 113 and 120 are placed on a flat table (not shown), and the fountains 111 and 117 are raised, and then lowered into the dovetail grooves 115 and 122 cut in the mold walls 114 and 121, respectively.

In an embodiment shown in FIG. *9c*, fastening faces 127 are formed on both mold 125 and fountain 126, which are fastened together with bolts 128 or by other means such as welding.

In an embodiment shown in FIG. *9d*, a dovetail groove 131 is cut in the mold wall 130, in which a fountain 132 having a dovetail 133 is fitted. Then, the fountain 132 is fastened to a mold 129 with bolts 134.

FIGS. 10 and 11 show an embodiment in which the fountain and mold are integrally put together by the above-described methods.

As shown, three vertical grooves 143 are provided around a mold 141, spaced at angular intervals of 120 degrees. A fountain 145 is fitted in each groove 143, and fastened to the mold 141 with a bolt 146. As in the foregoing embodiment, a cylindrical refractory brick 147 is fitted in the fountain 145. Foundry sand 148 is filled in a space between the fountain 145 and refractory brick 147.

A hot top 151 to be placed on the mold 141 has an annular frame 152 whose diameter is substantially equal to that of the top of the mold 141. The hot top 151 has an annular metal mold 154, vertical position of which being adjustable, that projects inward. The surface of the metal mold 154 is lined with a heat-insulating material 155. The annular frame 152 has a vertical opening 153, in which the top of the fountain 145 is inserted. The annular frame 152 and adjustable metal mold 154 are placed on the mold 141 with an annular spacer 156 therebetween.

A metal receiver assembly 161, consisting of an annular frame 162, a metal receiver 167 and a communication channel 169, rests on the hot top 151. The annular frame 162 has the same diameter as the annular frame 152 of the hot top 151. The annular frame 162 possesses a metal receiver support 164 that has three bridges 165 radially extending at angular intervals of 120 degrees. One end of the three bridges 165 each is attached to the flange 163 of the annular frame 162, while the opposite ends thereof meet at the center where a cylindrical support member 166 is provided. A cup-shaped metal receiver 167 of refractory brick is inserted in the support member 166.

The communication channel 169 of refractory brick, connecting the fountain 145 with the metal receiver 167, is mounted on the bridge 165. On the inside of the annular frame 162 is filled foundry sand 170 in order to fix the metal receiver 167 and communication channel 169 in position.

The hot top 151 and metal receiver assembly 161 thus put together are fastened to the mold 141 by means of a turnbuckle 172.

The fountain can also be fastened to the mold by other methods, such as shrink fitting. Any conventional fastening method will do, so long as adequate strength to withstand the great centrifugal force is obtainable. Likewise, no limitation is necessary as to the shape of the fastening parts if only they are strong enough. Preferably, however, the corresponding part of the mold wall should be made thicker. In the foregoing embodiments, the groove is formed in the mold and the projection on the fountain. The same result is obtained from the reversed combination, too; i.e. the projection on the mold and the groove in the fountain.

The independent fountain attached to the mold offers an advantage of fewer variations in the cooling rate than in the one formed within the mold wall.

As described above, this invention does away with the fountain by forming a vertical runner within the mold wall. Or, the fountain is fastened to the mold by fitting, bolting, or a combination of both. This permits easy fabrication and tight, high-strength fastening. All of this enables the entire mold to be rotated at high speed, without fracturing. Compared with the conventional apparatus in which the fountain is separately held in the upright position, the radius of rotation is smaller, which has eliminated the need for a large fountain supporter. The result is a reduction in apparatus size and weight. Also, dynamic balance can be controlled easily and preferably to reduce vibration.

Thus, this invention offers a great commercial advantage through a sharp reduction in mold assembling time resulting from the practical elimination of fountain supporting means, saving of power consumption due to a decrease in apparatus weight, and stabilization of product quality because of less vibration.

What is claimed is:

1. An apparatus for making ingots which comprises:

(a) a substantially cylindrical mold made of metal, including a vertical wall, said mold having an opening in the bottom thereof, (b) a stool provided with a runner in which said mold is placed, said runner communicating with said bottom opening of said mold, (c) a rotary table on which said stool is mounted, said rotary table being rotatable about a vertical axis and being equipped with means for rotating said table, (c) a vertical fountain detachably mounted along its length on the outer surface of said vertical wall of said mold, said fountain communicating with said runner, (d) said mold and said vertical fountain having respective outer walls having flat surfaces, and said fountain being fastened to said mold by bolts in such a manner that their respective flat surfaces closely contact each other; and (e) a metal receiver communicating with the top of the fountain, the entrance of said receiver being vertically disposed and said entrance to said receiver, said stool and said rotary table all having a common vertical axis of rotation.

2. The ingot-making apparatus according to claim 1 in which said metal receiver comprises an annular trough.

3. The ingot-making apparatus according to claim 1 further comprising a hot top mounted on said mold, said hot top having a vertical opening communicating with said fountain, said metal receiver comprising an annular frame placed on said hot top and a communication channel fitted in said annular frame so as to connect said metal receiver and said vertical opening.

4. The ingot-making apparatus according to claim 1 in which the metal receiver is funnel-shaped and is attached to a horizontal elbow connecting said receiver to the top of said fountain.

5. An apparatus for making ingots which comprises:

(a) a substantially cylindrical mold made of metal, including a vertical wall, having an opening in the bottom thereof, (b) a stool provided with a runner on which said mold is placed, said runner communicating with the bottom opening of said mold, (c) a rotary table on which said stool is mounted, said rotary table being rotatable about a vertical axis and being equipped with means for rotating said table, (d) a vertical fountain detachably mounted along its length on the outer surface of said vertical wall of said mold, said fountain communicating with said runner, (e) said vertical wall of said mold having a vertical hole or groove therethrough, said groove having an opening narrowing in the direction of the outer diameter of said mold, said fountain being detachably set in said hole or groove; and (f) a metal receiver communicating with the top of said fountain, the entrance of said receiver being vertically disposed and said entrance to said receiver, said stool and said rotary table all having a common vertical axis of rotation.

6. The ingot making apparatus according to claim 5, in which said metal receiver comprises a metal trough.

7. The ingot-making apparatus according to claim 5, further comprising a hot top mounted on said mold, said hot top having a vertical opening communicating with said fountain, said metal receiver comprising an annular frame placed on said hot top and a communication channel fitted in said annular frame so as to connect said metal receiver and said vertical opening.

8. The ingot-making apparatus according to claim 5 in which the metal receiver is funnel-shaped and is attached to a horizontal elbow connecting said receiver to the top of said fountain.

* * * * *